United States Patent [19]

Kemmerer et al.

[11] Patent Number: 4,693,362

[45] Date of Patent: Sep. 15, 1987

[54] CHAIN CONVEYOR FOR THE DELIVERY DEVICE OF PRINTING PRESSES

[75] Inventors: Klemens Kemmerer, Seligenstadt; Valentin Gensheimer, Muhlheim; Rudolf Melzer, Hainburg, all of Fed. Rep. of Germany

[73] Assignee: M. A. N. Roland Druckmaschinen Aktiengesellschaft, Fed. Rep. of Germany

[21] Appl. No.: 822,021

[22] Filed: Jan. 24, 1986

[30] Foreign Application Priority Data

Jan. 26, 1985 [DE] Fed. Rep. of Germany ..... 3502663

[51] Int. Cl.[4] ..... B65G 47/86

[52] U.S. Cl. ..... 198/803.7; 198/803.9; 101/408; 271/204; 271/277

[58] Field of Search ..... 198/470.1, 803.7, 803.9; 271/277, 204, 206, 82; 101/408

[56] References Cited

U.S. PATENT DOCUMENTS

| | | | |
|---|---|---|---|
| 2,024,140 | 12/1935 | Belluche | 198/803.7 |
| 2,756,995 | 7/1956 | Koch | 271/50 |
| 2,827,292 | 3/1958 | Koch | 271/50 |
| 2,882,049 | 4/1959 | Koch | 271/79 |
| 2,984,178 | 5/1961 | Koch | 101/409 |
| 3,414,259 | 12/1968 | Koch et al. | 271/82 |
| 3,591,169 | 2/1969 | Preuss | 271/50 |
| 3,826,486 | 7/1974 | Abendroth | 271/204 |
| 3,878,735 | 4/1975 | Preuss | 74/250 C |
| 3,972,413 | 8/1976 | Simeth | 198/180 |
| 4,111,123 | 9/1978 | Willeitner | 271/82 |
| 4,155,305 | 5/1979 | Heissler et al. | 101/408 |
| 4,408,525 | 10/1983 | Rebel | 101/183 |
| 4,409,741 | 10/1983 | Bonomi | 271/204 |

*Primary Examiner*—Joseph F. Valenza
*Attorney, Agent, or Firm*—Leydig, Voit & Mayer

[57] ABSTRACT

A chain conveyor for the delivery device of printing presses has gripper systems (1) being carrier directly by the endless conveying chains (2). The gripper system (1) is embodied by a unitary aluminum basic member (6). A steel tube (9) is cast into the basic member (6) at its center of gravity and over its whole length and optimizes the flexural and torsional rigidity of the gripper system (1).

7 Claims, 7 Drawing Figures

CHAIN CONVEYOR FOR THE DELIVERY DEVICE OF PRINTING PRESSES

BACKGROUND OF THE INVENTION

1. Field of the Invention

The invention relates to a chain conveyor for the delivery device of printing presses, the chain conveyor being of the kind having gripper systems carried by endless conveying chains, the gripper systems being secured to the conveying chains by way of connecting members retained by pins on the chains.

2. Description of the Related Art

A wide variety of chain conveyors are known; for example, West German Patent No. 2,424,917 discloses a chain conveyor which is carried directly by endless chains and which has a gripper system carried by common connecting members of adjacent chain rollers. The gripper system comprises a gripper shaft and a carrying or support tube. Various gripper rests or supports are secured to the support tube by screws. Also disposed on the support tube are mountings for guiding and retaining the gripper shaft, the mountings being secured by means of pins. Assembly of these rests and mountings on the tube were very elaborate and therefore very expensive, mainly because of the need for this multiplicity of components to be accurately aligned and adjusted. Also, the rest and mountings, unless screwed together properly, might undo themselves after a period of operation.

SUMMARY OF THE INVENTION

In view of the above, the primary object of the invention is to provide a chain conveyor which is resistant to torsion and bending and which even at high press speeds has reduced deflection due to inertial forces in the conveyor reversal zone.

Another object of the invention is to provide a gripper system having a reduced number of components to be accurately aligned, adjusted, and screwed into the gripper system.

Briefly, according to the invention, the gripper system for a chain conveyor is in the form of a unitary elongated aluminum basic member having dead heads of sprues. A cast-in steel tube is disposed substantially at the center of gravity of the basic member over the whole length thereof, and the steel tube is at substantially identical distances from the outer envelope of the basic member.

The gripper system is primarily composed of a unitary aluminum basic member. The use of aluminum substantially reduces overall weight. The shaping of the aluminum basic member provides considerably improved resistance to sag and twisting despite the weight reduction.

Even in the case of the heaviest stresses occurring during printing, components of the gripper system cannot become distorted or slip or release since the aluminum basic member is a unitary member. The external shape of the gripper system provides optimal flexural and torsional rigidity and a very reduced weight for its dimensions and requirements. The aluminum basic section is closed on itself and its geometric moment of inertia is adapted to the main loading plane. To this end, a substantial portion of the basic member is disposed opposite the force-receiving side. Preferably the basic member is trapezoidal in cross-section. There is therefore optical take-up of the forces occurring during deflection of the gripper system and of the torsional forces applied by the cam follower levers to the gripper systems. The gripper system is also shaped to ensure maximum freedom from shadow or mechanical interference (i.e., the area swept by the gripper system during operation is a minimum) so that driers are easily installed on the press. Since the mountings for the gripper shaft are cast on the aluminum basic member, the rigidity of the gripper system is further enhanced.

The aluminum basic member has integrally formed dead heads which are used as bearing places or mountings for the gripper shaft and also for the gripper rests. The simplifications in assembly which have been identified above arise from the face that the aluminum basic member is simple to machine in two working steps.

A cast-in steel tube is disposed substantially at the center of gravity of the basic member and over the whole length thereof. The introduction of the steel tube makes it unnecessary to use a sand core. It would be virtually impossible to use a sand core to produce a basic member having these longitudinal and cross-sectional relationships. Also, if the steel tube is heated before pouring, the aluminum does not cool too fast and so the finished casting stays free of shrink holes. The shaping—i.e., the substantially identical wall thicknesses—provides optimal uniformization of the structure of the complete casting over the whole length thereof.

The steel tube is shrunk on to the casting after cooling in the conventional manner, since the coefficient of expansion of aluminum is considerably greater than that of steel. The steel tube cannot work loose even at high press speeds. The box shape enhances rigidity as compared with a solid shape. The weight reduction referred to above is very advantageous at high press speeds by contributing towards very quiet running. The weight reduction arising from the shaping and the choice of aluminum as the material enables the press to run at the maximum speeds now current—i.e., faster than 10,000 sheets/hour—yet the gripper systems can always cope satisfactorily with the mass centrifugal forces and the resulting loadings arising precisely in the reversal zone of the conveyor path.

The integrally formed dead heads used as gripper rests are so shaped to permit gripper rests or pads in the form of plastic mouldings to be introduced in the direction of the closing movement of the grippers and therefore cannot fall out or release, since the closing movement of the grippers always returns the plastic mouldings to their secured end positions. To this end, the plastic mouldings have a central semicircular guide providing optimal retention combined with ready assembly.

An angle member is secured to the conveying chain as a connnecting member and the gripper system is screwed to the angle member. The gripper system is therefore installed just by screwing both its ends, in each case with two screws, to respective angle members of the chains. The gripper system can be replaced just by releasing the screws. In the assembly of the basic member the chains are disposed in the lateral guides of the press—i.e., the chains are not open, which would considerably complicate assembly of the gripper systems.

BRIEF DESCRIPTION OF THE DRAWINGS

Other objects and advantages of the invention will become apparent upon reading the following detailed description and upon reference to the drawings, in which.

Figure 1A:
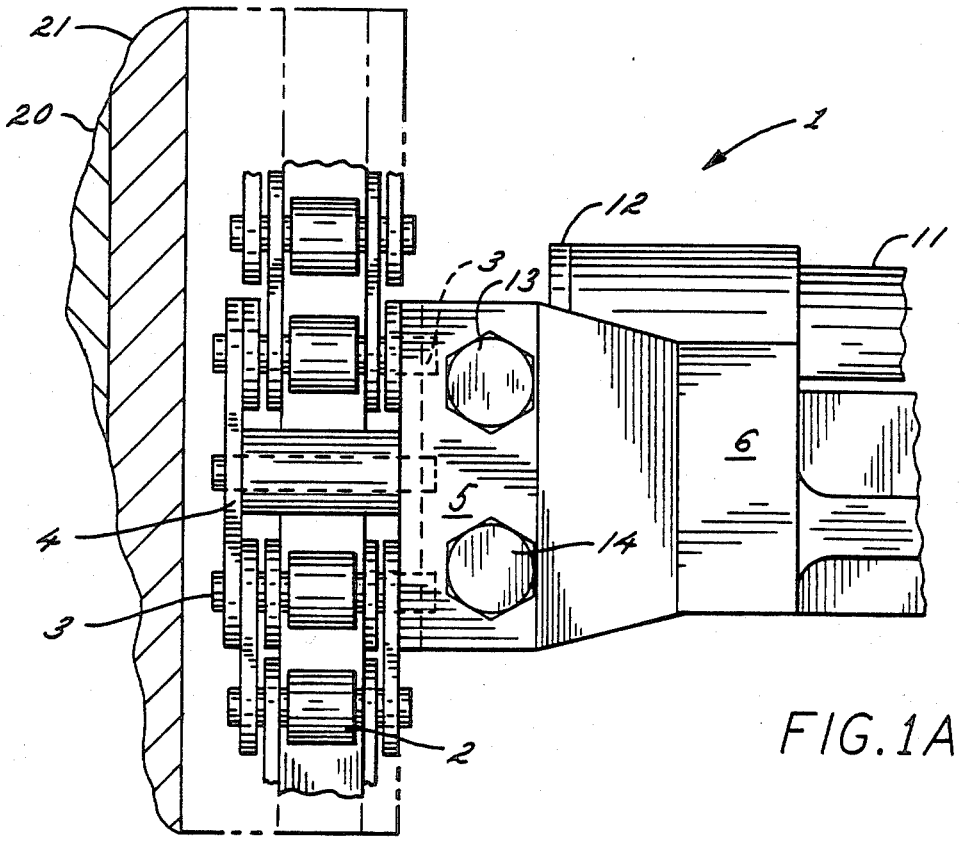
FIG. 1A and FIG. 1B are partial views of a chain conveyor of a printing press showing a conveying chain and a gripper system secured thereto.

While the invention is susceptible to various modifications and alternative forms, a specific embodiment thereof has been shown by way of example in the drawings and will herein be described in detail. It should be understood, however, that it is not intended to limit the invention to the particular form disclosed, but on the contrary, the intention is to cover all modifications, equivalents, and alternatives falling within the spirit and scope of the invention defined by the appended claims.

DESCRIPTION OF THE PREFERRED EMBODIMENT

Figure 1B:
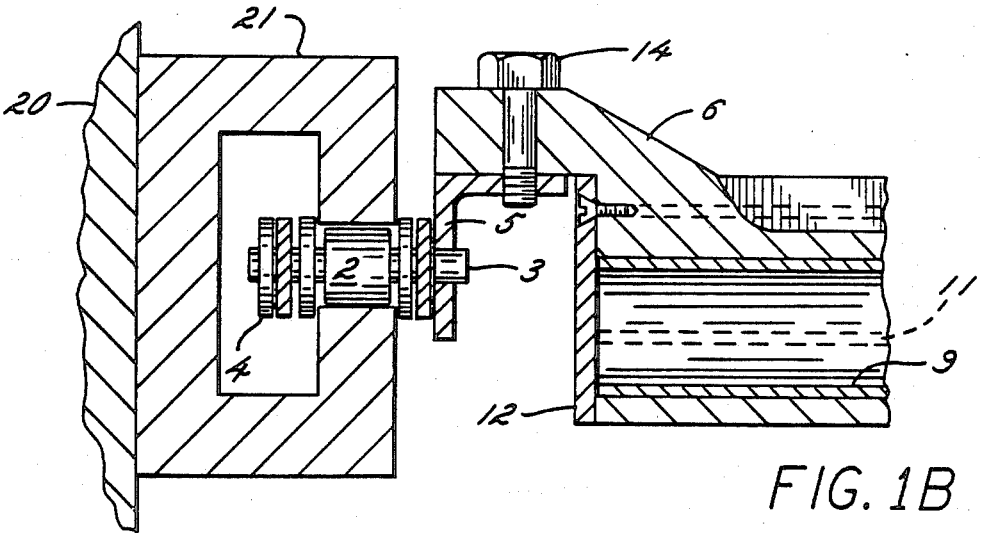

Turning now to the drawings, FIGS. 1A and 1B show a gripper system 1 of a printing press. Since the use of chain conveyors in the printing art is well known, the press is not shown in any further detail. A reader unfamiliar with the use of chain conveyers may obtain a general knowledge of the subject matter from Abendroth U.S. Pat. No. 3,826,486 herein incorporated by reference. The gripper system 1 is secured by pins 3 to a conveying chain 2. As is conventional, the chain 2 is guided in a closed trackway 21 mounted to a side wall 22 of the printing press. A method of further sealing the chain 2 in the trackway 21 is described in Preuss U.S. Pat. No. 3,878,735.

In the zones where the systems 1 are present the chain 2 is locked by means of connecting members 4. On the side of the chain where the system 1 is disposed, an angle member 5 is secured by the pins 3 to the chain 2. On the other side of the chain 2 and opposite the member 5 is the connecting member 4 which is also secured by the pins 3 to the chain 2. The pins 3 therefore anchor the members 4, 5 firmly in the chain 2.

The system 1 is assembled in the press by being screwed to the angle member 5 by screws 13, 14. The assembler or fitter secures a gripper system 1, then advances the chain 2 just as far as the next angle member 5 inside the chain 2, and then the fitter screws the next system 1 to that angle member 5 by means of another pair of screws 13, 14. It should be understood that these fastening operations are performed at each end of the gripper system 1 so that the system is suspended between a pair of chains 2, as further shown and described below in connection with FIG. 5. The gripper system is therefore retained optimally at both ends by means of the angle members 5 and assembly can be carried out with the chains 2 in the closed state.

To save weight the system 1 is embodied by a unitary aluminum basic or body member 6 which also helps to reduce considerably the time needed to assemble the gripper system 1.

Figure 2:
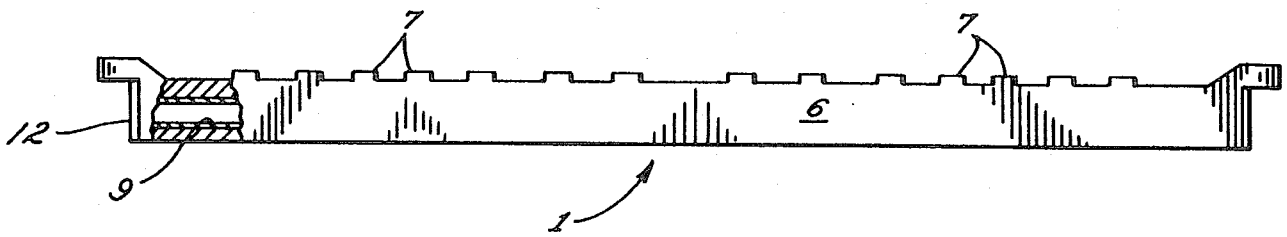
FIG. 2 shows a unitary cast gripper system having an inserted steel tube and a number of sprues or dead heads.

FIG. 2 is a side view showing the whole length of the basic member 6. Disposed therein is a steel tube 9 which greatly enhances the rigidity of the aluminum basic member 6. The aluminum basic member 6 has integrally formed dead heads 7 which can be given their final shaping by machining in a single step after casting, for example as taught in Abendroth U.S. Pat. No. 3,826,486. The deadheads 7 are therefore casting zones which are present after the production of the crude member 6 and which can be machined inexpensively in a single step.

Figure 3:
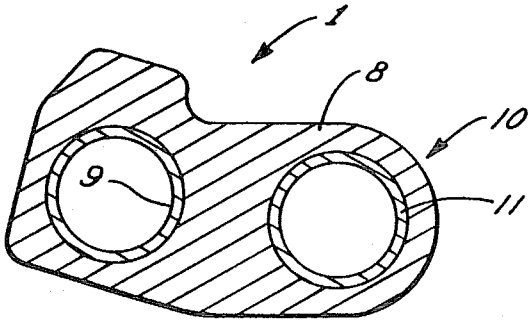
FIG. 3 is a sectioned view in side elevation of the gripper system showing mounting for retaining the gripper shaft.

FIG. 3 is a side view of the gripper system 1 near an integrally formed dead head 8 providing a mounting 10 for a gripper shaft 11. The mounting 10 is produced by means of a machine tool which registers over the whole length of the system 1. The holes receiving the gripper shaft 11 are machined in a single working step by drilling the sprues 8, but the entire length of the system 1 is not drilled. One end of the system is left open for the entry of the shaft 11 and the opposite end of the system is in the closed state. After the shaft 11 has been introduced, the open end is closed on the end face by means of a closure member 12.

Figure 4:
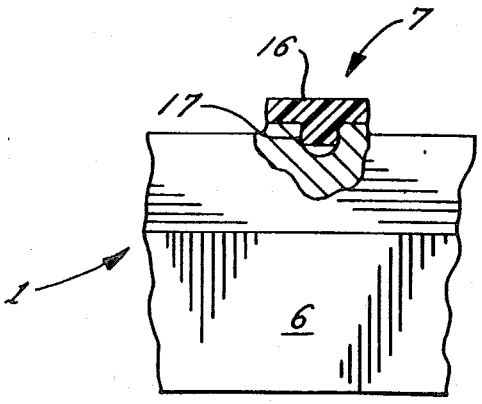
FIG. 4 is a partial view of the gripper system near the gripper rests in which plastic mouldings are secured by means of special retaining means.

FIG. 4 is a detailed view of the deadhead 7. A semicircular web 17 is milled into the deadhead 7 and a matching shape in the form of a plastic moulding 16 is then introduced into the web 17 and stuck therein. The plastic moulding 16 is the support or rest for the gripper, shown and described further below in connection with FIG. 6.

Figure 5:
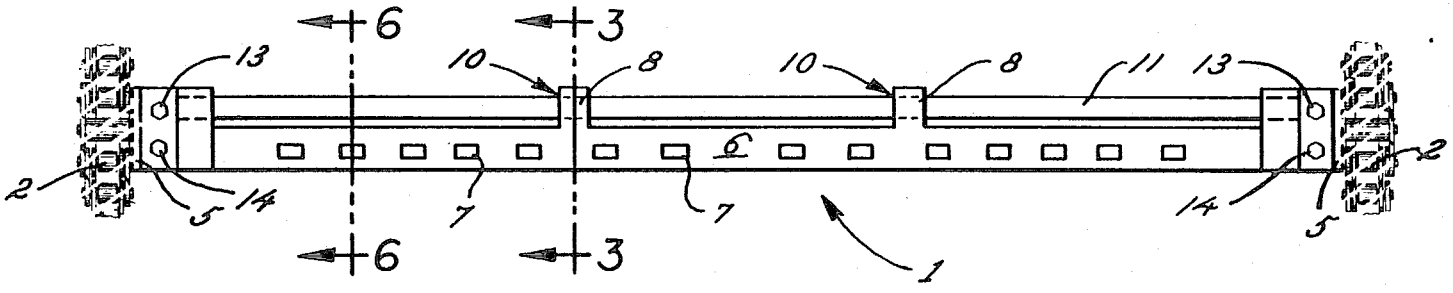
FIG. 5 is a plan view of the gripper system with the gripper shaft fitted.

FIG. 5 is a plan view of the gripper system 1 with the gripper shaft 11 fitted. The shaft 11 is mounted in the mountings 10 which provide additional strengthening of the basic member 6. The distribution of the deadheads 7 on the basic member 6 is readily apparent from FIG. 5. The gripper system 1 is screwed at both its side ends to respective angle members 5 of respective chains 2 (shown in phantom lines) by the screws 13, 14.

Figure 6:
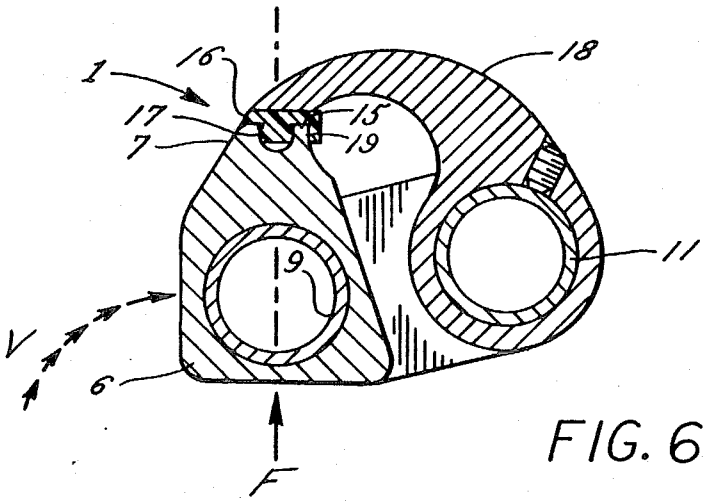
FIG. 6 is a sectioned view through the trapezoidal aluminum basic member and showing a gripper and gripper rest installed.

FIG. 6 shows a cross-section of the aluminum basic member 6 in the vicinity of a deadhead 7. Because of the trapezoidal shape the geometrical moments of inertia are adapted to the main loading planes. During operation of the printing press, for example, the velocity V of the gripper system 1 changes direction, and this acceleration causes some deflection of the basic member 6 as if a force F were imposed normal to the velocity V as shown in FIG. 6. The cast-in steel tube 9 is disposed centrally inside the basic member 6. This shaping, and the use of the box shape with an inserted steel tube 9, considerably improves the sagging and twisting resistance of the gripper system 1.

As further shown in FIG. 6, the gripper 18 cannot loosen the moulding 16 since the pushing motion of the gripper 18 presses the mouldings 16 against an end stop 15 of the deadhead 7. The moulding 16 is right-angled and also rests by way of its right-angled external shape on a side stop 19 of the sprue 7. The end stop 15 and side stop 19 are fashioned by machining the sprue 7. The rectangular support system, the semicircular web 17 and the sticking of the plastic moulding 16 obviate any loosening of the gripper rest.

What is claimed is:

1. A chain conveyor for a printing press, said chain conveyor having at least one gripper system being carried by endless conveying chains, the gripper system being secured to the conveying chains by way of connecting members retained by pins on said chains, said gripper system including a gripper shaft and a plurality of pivotably movable sheet engaging gripper members mounted on said gripper shaft, wherein the improvement comprises, said gripper system having a unitary and elongated body member and a a tubular structural member disposed substantially at the center of gravity of the body member and extending the length thereof for enhancing the structural rigidity of said body member, and said body member having first integrally formed means for supporting said gripper shaft and second integrally formed means form for limiting pivotal movement of said gripper members when in a sheet engaging position.

2. A conveyor according to claim 1, wherein said connecting members each comprise an angle member secured to a respective end portion of the gripper system.

3. A conveyor according to claim 2, wherein said angle member is secured to a respective end portion of the gripper system by means of two screws.

4. A conveyor according to claim 1 in which said body member is made of aluminum and said tubular structural member is made of steel.

5. A conveyor according to claim 1 including a plastic molding mounted on said second integrally formed means of said body member against which said gripper members bear when in a sheet engaging position.

6. A conveyor according to claim 1 wherein said body member has a trapisodial shape with the base of the trapisoid being opposite said second integrally formed means.

7. A conveyor according to claim 6 in which said tubular structural member is disposed between said base of said body member and said second integrally formed means.

* * * * *